United States Patent [19]

Nakamura et al.

[11] 4,193,634

[45] Mar. 18, 1980

[54] METHOD AND APPARATUS FOR EXCAVATION

[75] Inventors: Joji Nakamura, Kamakura; Kihachiro Furumi, Hiratsuka, both of Japan

[73] Assignee: Kabushiki Kaisha Komatsu Seisakusho, Tokyo, Japan

[21] Appl. No.: 857,755

[22] Filed: Dec. 5, 1977

[51] Int. Cl.[2] ..... E21C 25/60

[52] U.S. Cl. ..... 299/17; 299/20; 175/65; 175/422

[58] Field of Search ..... 299/17, 20–22, 299/23, 16, 10; 166/223; 175/65, 422

[56] References Cited

U.S. PATENT DOCUMENTS

| | | | |
|---|---|---|---|
| 999,000 | 7/1911 | Trippe | 299/20 |
| 3,055,648 | 9/1962 | Lawrence et al. | 299/20 |
| 3,193,012 | 7/1965 | Huitt et al. | 166/223 X |
| 3,565,488 | 2/1971 | Walsh | 299/22 |

FOREIGN PATENT DOCUMENTS

| | | | |
|---|---|---|---|
| 909881 | 11/1962 | United Kingdom | 299/17 |

*Primary Examiner*—William F. Pate, III
*Attorney, Agent, or Firm*—Armstrong, Nikaido, Marmelstein & Kubovcik;

[57] ABSTRACT

A method and an apparatus for excavating a tunnel, hole, channel or the like in the rock mass or in the ground by using pressurized water spouted from nozzles.

The method comprises the steps of digging a hole in the rock mass, inserting a rod of a fracturing apparatus in the hole, the rod having a communicating hole formed therein and nozzles formed at the leading end thereof, jetting pressurized water from the nozzles so as to produce grooves in the hole impinged by the water jet, sealing a space around the nozzles defined by the outer periphery of the rod and an inner peripheral wall of the hole, and again allowing pressurized water to spout from the nozzles into the space thereby forming cracks in the rock mass.

13 Claims, 10 Drawing Figures

METHOD AND APPARATUS FOR EXCAVATION

BACKGROUND OF THE INVENTION

This invention relates to a method and apparatus for excavating a tunnel, shaft, channel or the like in a rock mass or in the ground.

Heretofore, various methods and apparatus have been proposed for the excavation of tunnels.

When a tunnel is to be excavated, for instance, holes are drilled in the face of the tunnel under construction by means of, for instance, a so-called drill jumbo, explosives are inserted into the holes and is exploded, and the result is removed by a mucking device and is transported backward.

Since explosives are used in such system of excavation, noise, air pollution, and safety problem will occur unavoidably.

Recently, tunnel excavation methods utilizing more mechanized apparatus, such as shield machines or mechanical tunnel boring machines, have been developed and utilized widely. However, the shield method cannot be applied effectively in rock tunnel stratum, and the system by means of mechanical tunnel boring machine tends to be excessively high in cost and is limited in application to specific cases in the good ground condition.

SUMMARY OF THE INVENTION

It is an object of the present invention to provide a non-explosive-method and apparatus for excavating tunnel, shaft, channel or the like in a rock mass or in the ground.

Another object of the present invention is to provide an excavation method and apparatus using pressurized water.

A still another object of the present invention is to provide an economical method and apparatus for excavating tunnel, shaft, channel or the like.

In accordance with an aspect of the present invention, there is provided a method of excavating tunnel, shaft, channel or the like comprising the steps of (a) digging a hole in a rock mass or in the ground;

(b) inserting a rod of a fracturing apparatus in said hole, said rod having a communication hole formed therein in the axial direction and nozzle means formed at the leading end thereof, said fracturing apparatus having a water reservoir and a hydraulic booster;

(c) allowing pressurized water to spout from said nozzle means so as to produce grooves in said hole impinged by the water jet, the pressurized water being introduced into said nozzle means from said water reservoir through said communication hole by the action of said hydraulic booster;

(d) sealing a space around said nozzle means defined by the outer periphery of said rod and an inner peripheral wall of said hole; and (e) allowing pressurized water to spout from said nozzle means into said space thereby making a crack in said rock mass, said crack being started from said grooves in said hole, the water pressure employed in this step being less than that of step (c) whereby enabling the rock mass to be fractured along said crack by continuously spouting pressurized water into said space.

In another aspect of the present invention, the above-described and other objects of the present invention can be achieved by an apparatus for excavating a tunnel, shaft, channel or the like comprising:

a base frame, a guide bar rotatably mounted on said base frame, a housing slidably mounted on said guide bar, a rod slidably and rotatably mounted on said housing, said rod having a communication hole formed therein in the axial direction, nozzle means formed in said rod, said nozzle means being connected with said communication hole, a water reservoir, hydraulic booster means mounted on said base frame, and piping means for connecting said water reservoir with said communication hole and said hydraulic booster means so that water pressurized by said hydraulic booster can be spouted in the form of water jet from said nozzle means thereby making a crack in a rock mass or in the ground to be excavated.

The above and other objects, features, and advantages of the present invention will be readily apparent from the following description taken in conjunction with the accompanying drawings.

DETAILED DESCRIPTION OF THE PREFERRED EMBODIMENTS

Figure 1:
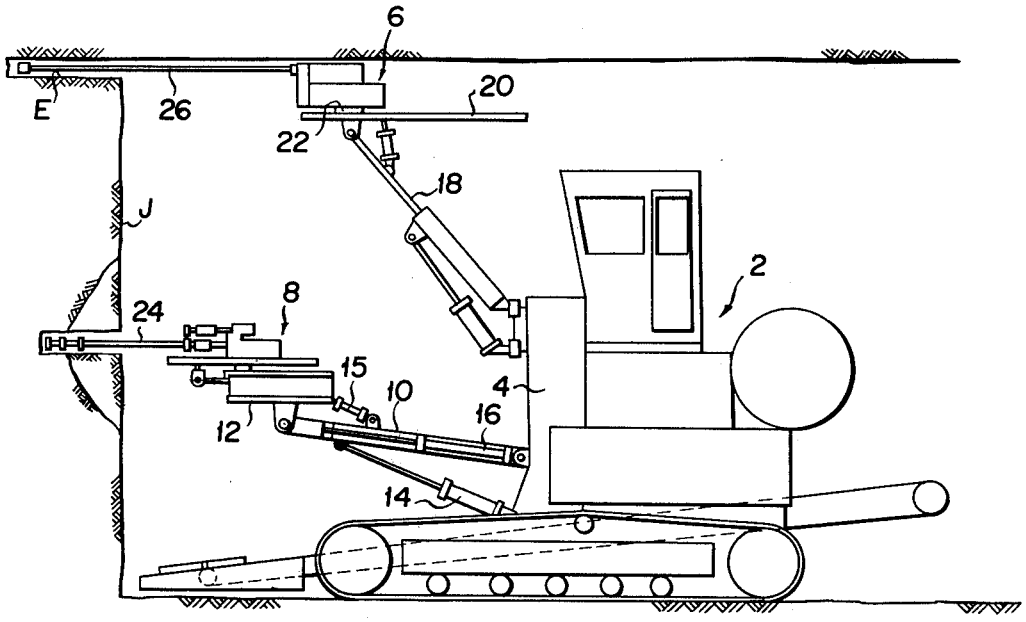
FIG. 1 is a side elevational view of a tunnel excavator equipped with a rock mass fracturing apparatus according to the present invention.
Figure 2:
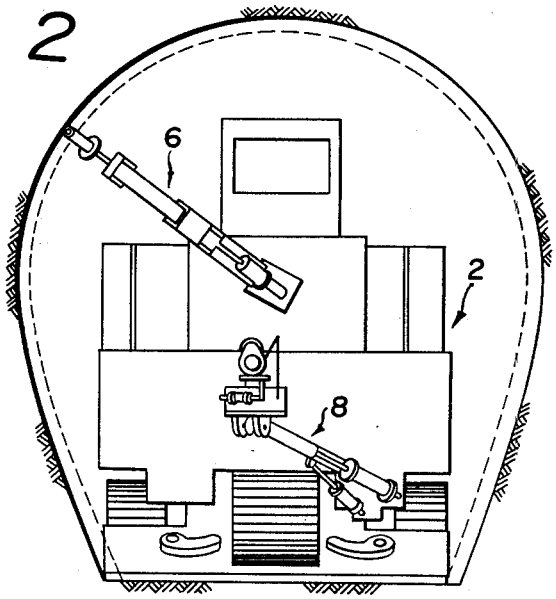
FIG. 2 is a front elevational view of FIG. 1.
Figure 3:
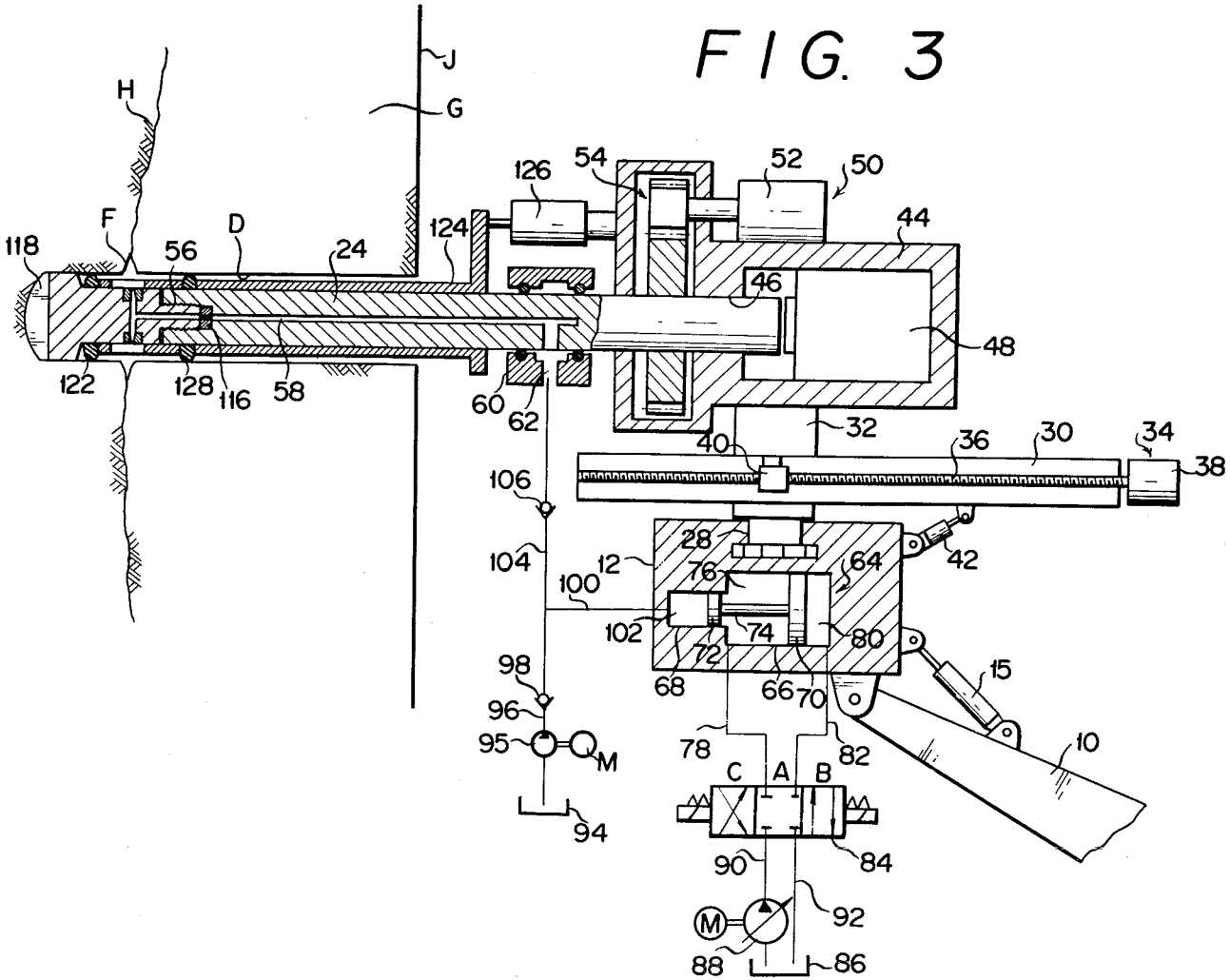
FIG. 3 is a schematic side elevational view partially in cross-section of a rock mass fracturing apparatus according to the present invention.

The present invention will now be described in detail below with reference to the accompanying drawings. FIGS. 1 and 2 illustrate an embodiment in which the rock mass breaking or excavating apparatus of the present invention is employed as a tunnel excavating means. In the drawings, reference numeral 2 denotes a vehicle such as endless track type tractors etc. The vehicle 2 has a body frame 4 fitted with a planned excavation line drilling means 6 and a rock bed fracturing apparatus 8. The rock mass fracturing apparatus 8 has a base frame 12 mounted pivotally through a boom 10 to the body frame 4 of the vehicle 2. The base frame 12 is arranged to be moved up and down by the action of hydraulic cylinders 14 and 15 and moved horizontally or to the left and right by the action of a hydraulic cylinder 16. The planned excavation line drilling means 6 is pivotally connected through a boom 18 to the body frame 4, and can be moved forwards and backwards along a guide bar 20. Reference numeral 22 denotes a frame which can be moved forwards and backwards by means of a moving operation means (not shown). Reference numeral 24 denotes a rod of the rock mass fracturing apparatus, and 26 a rod of the planned excavation line drilling means. Referring to FIG. 3, the base frame 12 has a guide bar 30 fitted thereto so as to be rotated about a shaft 28, the guide bar 30 having a frame 32 fitted thereto so as to be moved forwards and backwards. The guide bar 30 is provided with a moving operation means 34 adapted to move the frame 32. The moving operation means 34 has a screw shaft 36 rotatably attached to the guide bar 30, the screw shaft 36 being connected to the output side of a mover means 38. The screw shaft 36 is engaged with a nut means 40 of the frame 32.

The above-mentioned base frame 12 has a hydraulic cylinder connected thereto for gyrating the guide bar 30. Fixedly mounted on the frame 32 is a housing 44 having a bearing portion 46 formed therein through which the rod 24 extends so as to be rotated and moved forwards and backwards or reciprocably. The fixed housing 44 comprises a shock generating means 48 mounted within the housing and adapted to give shock to the rod 24, and a rotary driving means 50 mounted on the housing adapted to rotate the rod 24. The rotary driving means 50 comprises a motor 52 for rotating the rod 24, and the output side of the motor 52 is connected through gear means 54 to the rod 24. The rod 24 has a threaded hole 56 formed in one terminal face thereof. The rod 24 has a communication hole or passage 58 formed therein and extending from the bottom of the threaded hole 56 to the rear side terminal face thereof. The rod 24 is provided with a swivel joint 60 having a hole 62 formed therein and connecting to the above-mentioned hole 58.

The above-mentioned base frame 12 is provided with a hydraulic booster means 64 which comprises a large diameter cylinder portion 66 and a small diameter cylinder portion 68. The cylinder portions 66 and 68 have pistons 70 and 72 accommodated therein, respectively, and interconnected by a piston rod 74. The large diameter cylinder portion 66 defines a chamber 76 on the rod side which is connected through a line 78 to a three-position electromagnetic valve 84 and defines a chamber 80 on the head side which is connected through a line 82 to the electromagnetic valve 84.

The electromagnetic valve 84 has a central or neutral position "A" wherein it is shut off, a first offset position "B" wherein the hydraulic fluid or oil is supplied by a pump 88 from a tank 86 through lines 90 and 78 to the rod side chamber 76 and the hydraulic fluid expelled from the head side chamber 80 is allowed to return through a line 82 and a return line 92 into the tank 86, and a second offset position "C" wherein the hydraulic fluid deliverred by the pump 88 is supplied through the lines 90 and 82 into the head side chamber 80 whilst the hydraulic fluid expelled from the rod side chamber 76 is allowed to return through the line 78 and the return line 92 into the tank 86. Reference numeral 94 indicates a water reservoir connected through a pump 95, a line 96, a check valve 98 and a line 100 to a head side chamber 102 of the small diameter cylinder portion 68. The head side chamber 102 communicates further through the line 100, a line 104 and a check valve 106 with the communication hole 62 of the swivel joint 60.

Figure 4:
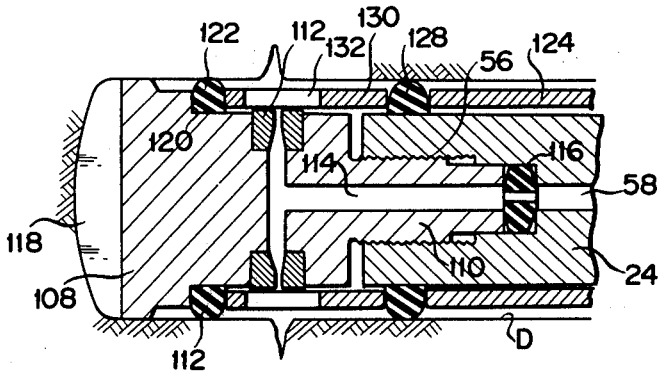
FIG. 4 is an enlarged cross-sectional view showing the leading portion of a rod of the rock mass fracturing apparatus according to the present invention.

As best shown in FIG. 4, the threaded hole 56 of the rod 24 is threadably engaged with a threaded portion 110 of a nozzle holder member 108. Mounted on the nozzle holder member 108 are a single or a plurality of nozzles 112 communicating through a communication hole 114 with the aforementioned communication hole 58. Reference numeral 116 denotes a seal means. Fixedly secured to the leading end of the nozzle holder member 108 is a rock mass excavating blade 118. The nozzle holder member 108 has a seal holding portion 120 formed in the peripheral part thereof and in which a seal 122 is inserted. The above-mentioned rod 24 has a collar or sleeve 124 adapted to be slidably fitted over the periphery of said rod 24, whilst the above-mentioned fixed housing 44 is provided with a cylinder 126 for actuating the sleeve 124. The terminal face of the sleeve 124 abuts against a seal 128, and the above-mentioned nozzle holder member 108 is fitted with a collar 130 positioned between the seals 122 and 128, the collar 130 having an opening 132 formed therein opposite to the nozzle 112. Since the nozzle holder member 108 having the nozzles mounted thereon is threadably engaged with the rod 24, the nozzle holder member 108 can be easily attached and detached, and also a nozzle holder member having nozzles with altered injection angle or a plurality of nozzles more than a pair can be attached to the rod 24. The outside diameter of the seals 122 and 128 is usually smaller than that of the excavating blade 118 in order to prevent their wear-down, and the arrangement is made such that when the sleeve 124 is urged to the left in the drawing by the action of the hydraulic cylinder 126 their outside diameter portions will expand and contact with the peripheral surface of the excavated hole thereby sealing it. Further, the excavating blade 118 mounted on the leading end of the nozzle holder member 108 may be omitted or detached in the case when hole "D" through which the rod 24 passes is previously excavated by means of another well-known excavating apparatus.

Figure 5:
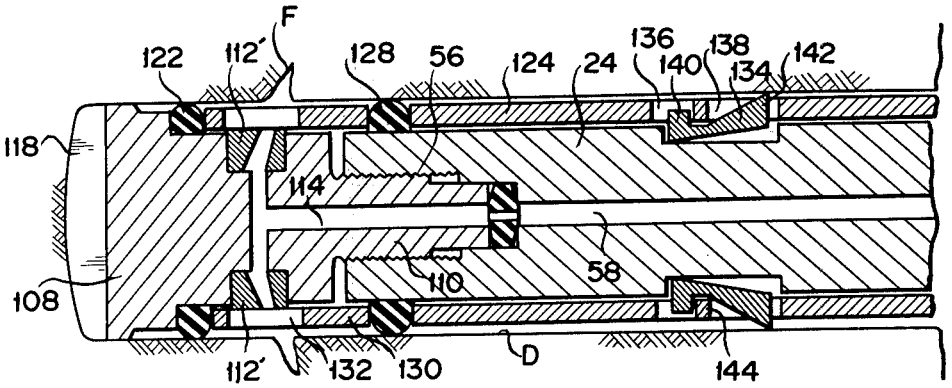
FIG. 5 is similar to FIG. 4 but showing another embodiment of a rod of the rock mass fracturing apparatus according to the present invention.

Referring to FIG. 5, there is shown another embodiment in which modified rod and nozzles of the present invention is employed. This embodiment differs from that shown in FIG. 4 in the injection angle of nozzle 112' and in that a rock bed pulling out gripper means 134 is located approximately central part of the sleeve 124. The sleeve 124 has notches 136 and 138 formed therein. The gripper means 134 has a head portion 140 fitted in the notch 136 and a tail portion 142 fitted in the notch 138. The gripper means 134 is divided into three or four sections fitted on the peripheral surface of the rod 24. When the sleeve 124 is urged to the left in the drawing by the action of the actuator cylinder 126, the head portion 140 of the gripper means 134 is pushed to the left by a partition member 144 of the sleeve 124 so that the tail portion 142 of the gripper means 134 can abut against the inner peripheral surface of the hole "D."

Figure 6:
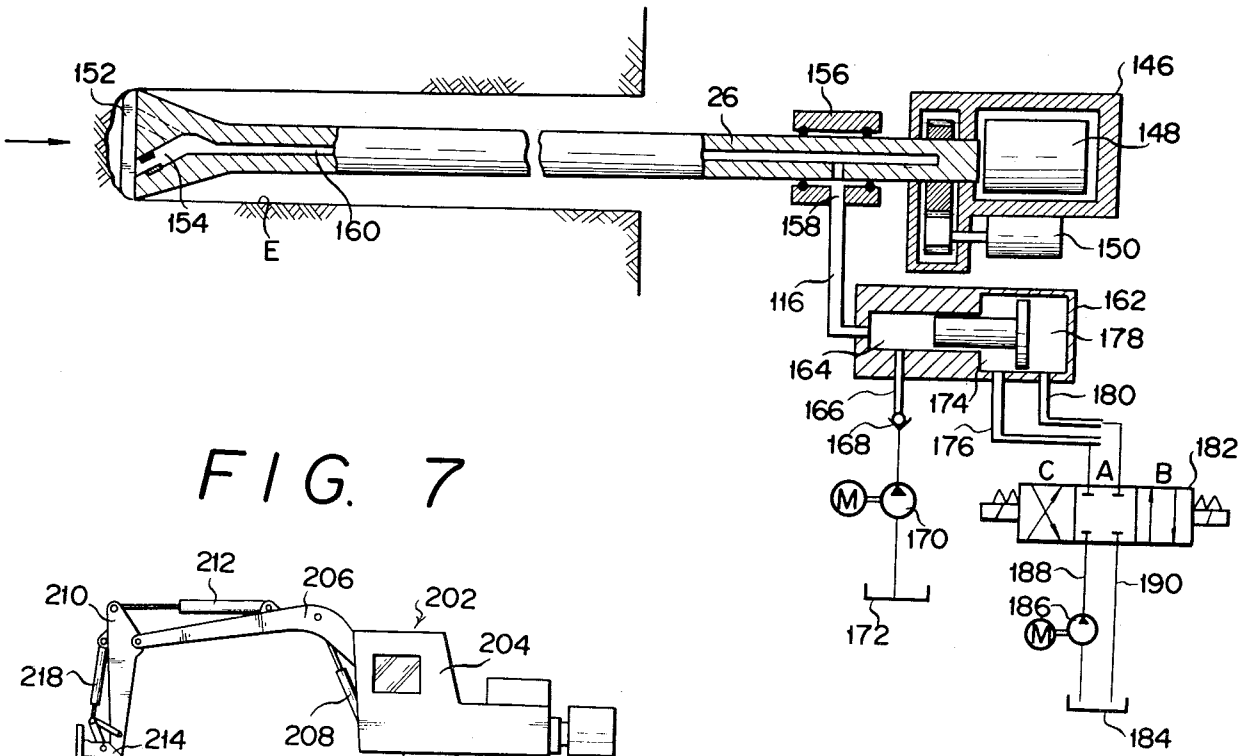
FIG. 6 is a side elevational view partially in cross-section of a drilling means according to the present invention.

In FIG. 6, there is shown a planned excavation line drilling means including a housing 146 mounted on a frame 22 as shown in FIG. 1. The housing 146 has a rod bearing portion on which a rod 26 is mounted rotatably and movably forwards and backwards. The housing 146 is provided with a striking means 148 adapted to give shock to the rod 26 and a rotary driving means 150 adapted to rotate the rod 26. Mounted on the leading end of the rod 26 in an excavating blade 152, and also formed in the leading end is a nozzle 154. The rod 26 is provided with a swivel joint 156 which has a communication hole 158 adapted to communicate through a communication hole 160 with the nozzle 154. Reference numeral 162 denotes a hydraulic booster means which has a chamber 164 communicating through piping 116 with a communication hole 158 of swivel joint 156. The chamber 164 is allowed to communicate through a line 166, a check valve 168 and a pump 170 with a fluid or water reservoir 172. The hydraulic booster means 162 defines a chamber 174 connected through a line 176 to a three-position electromagnetic valve 182, and a chamber 178 connected through a line 180 to the electromagnetic valve 182. The three-position electromagnetic valve 182 has a central or neutral position "A" wherein it is closed, a first offset position "B" wherein the hydraulic fluid or oil is supplied by a pump 186 from a tank 184 through lines 188 and 176 into the chamber 174, whilst the hydraulic fluid or oil expelled from the chamber 178 is returned through the line 180 and a return line 190 into the tank 184, and a second offset position "C" wherein the hydraulic fluid or oil is supplied by the pump 186 from the tank 184 through the lines 188 and 180 into the chamber 178, whilst the fluid expelled from the chamber 174 is returned through the line 176 and the return line 190 into the tank 184.

OPERATION

The operation of the apparatus of the present invention constructed as mentioned hereinabove will now be described below.

As for the first step for excavating a tunnel, the planned excavation line drilling means 6 is used to excavate rock mass "G" to form an approximately annular planned excavation line "E."Stated more specifically, in the planned excavation line drilling means 6, the striking or shock generating means 148 is driven so as to strike against the rod 26, and at the same time the rotary driving means 150 is driven to rotate the rod 26 so that the excavating blade 152 attached to the leading end of the rod 26 can excavate the rock bed "G" so as to form a planned excavation line in an annular groove.

In this case, as and when required, the hydraulic booster means 162 is rendered operative to spout a pressurized water jet from the nozzle 154 to cut rock mass and to allow rock chips to exit from the annular groove. The operation of the hydraulic booster means 162 will now be described below. At first, the pump 170 is driven to supply water from the water reservoir 172 into the chamber 164, and at the same time, the electromagnetic valve 182 is offset to "B" position and the pump 186 is driven to supply the fluid or oil from the tank 184 into the chamber 174. After the chamber 164 has been filled with water, the electromagnetic valve 182 is changed over to "C" position and the pump 186 is driven to supply the hydraulic fluid into the chamber 178 so that the water within the chamber 164 is pressurized so as to spout from the nozzle 154 in the form of water jet. Upon completion of planned line excavation, the rock bed fracturing apparatus 8 is driven to excavate the rock bed "G." Regarding the operation of the rock bed fracturing apparatus 8, the motor 52 of the rotary driving means 50 is driven or rotated so as to rotate the rod 24 through the gearing 54, and at the same time the striking means or shock generating means 48 is driven to give shock to the rod 24 thereby allowing the excavating blade 118 fitted to the leading end of the rod 24 to excavate the rock bed "G" and form a fracturing hole "D." Upon completion of the fracturing hole "D," the pump 95 is driven to supply water from the water reservoir 94 through the line 96, the check valve 98 and the line 100 into the chamber 102, and at the same time, the electromagnetic valve 84 is changed over to "B" position and the variable displacement pump 88 is driven to supply the hydraulic fluid or oil from the tank 86 through the line 90, the check valve 84 and the line 78 into the chamber 76. The supply of the hydraulic fluid or oil into the chamber 76 provides movement of the integrally connected pistons 70, 72 and the piston rod 74 to the right so that the water from the water reservoir 94 can be drawn in the chamber 102. Therefore, in combination of the operation of the pump 95, water can be rapidly filled in the chamber 102.

When the chamber 102 has been filled with water, the electromagnetic valve 84 is changed over or offset to "C" position so as to allow the pressurized hydraulic fluid or oil deliverred by the pump 88 to be supplied through the line 90, the electromagnetic valve 84 and the line 82 into the chamber 80. Upon completion of the supply of the pressurized fluid or oil into the chamber 80, the water within the chamber 102 is compressed or pressurized because the outside diameter of the piston 72 is smaller than that of the piston 70. The pressurized water is introduced through the lines 100 and 104 and the check valve 106 into the communication hole 58 of the rod 24, and is allowed to spout through the nozzles 112 in the form of water jet. The pressure of the water jet spouting through the nozzles reaches a high pressure such as for example, about 4,000 to 5,000 kg/cm$^2$, such high pressure water jet serving to form groove "F" in the rock mass "G." The pressure of the water jet can be varied by altering the discharge capacity of the variable displacement pump 88. The pressure of the water jet at the nozzles needs not be restricted to the above-mentioned figures, but should be high enough to form such groove in the rock mass in a comparatively short time.

Upon completion of the formation of the groove "F" by the action of the water jet in the rock bed "G", the electromagnetic valve 84 is changed over to the neutral position "A" so as to cut off the supply of the high pressure water to the nozzle 112. In this case, at the same time, the pump 95 is stopped so as to stop the spouting of water through the nozzles 112.

Next, the actuator cylinder 126 is actuated to move the sleeve 124 to the left in the drawing to compress the seals 122 and 128 thereby allowing the peripheral surfaces of the seals 122 and 128 to contact with that of the fracturing hole "D" so as to seal the portion between the seals 122 and 128. Then, the pump 95 is driven to supply the water stored in the water reservoir 94 into the chamber 102, and at the same time the electromagnetic valve 84 is offset to "B" position to allow the pressurized fluid or oil delivered by the pump 88 to be supplied into the chamber 76, thus assisting pumping-up of water from the water reservoir 94. When the chamber 102 has been filled with water, the electromagnetic valve 84 is offset to "C" position so that the pressurized fluid or oil from the pump 88 is supplied into the chamber 80. In consequence, the water accommodated in the chamber 102 is pressurized so as to pass through the communication hole 58 and spout from the nozzles 112 in the form of water jet. The water pressure in this step may be lower than that of the water jet in the above-mentioned first step, and is enough to meet the requirements at 200 to 300 kg/cm$^2$. The adjustment of the water jet pressure can be effected by altering the discharge capacity of the variable displacement pump 88. When the water jet spouts through the nozzles 112, because of the fracturing hole "D" including the groove "F" being sealed by the seals 122 and 128, the pressure of water charged into the enclosed space will increase substantially thereby forming crack "H" along the groove "F" in the rock mass "G." When the nozzles 112 continue to spout water, the formation of crack is developed till it reaches the pit face thereby fracturing the rock mass. In the embodiment of FIG. 5 wherein the rod 24 is provided with a gripper means 134, when the crack "H" has developed sufficiently into the rock mass "G", the pump 95 is stopped and the electromagnetic valve 84 is changed over to the neutral position "A" so as to stop the spouting of water jet from the nozzle 112. Subsequently, the rock mass fracturing apparatus 8 is moved on the guide bar 30 backwards or to the right in the drawing. As a result, the rod 24 is drawn out so that because of the tail portion 142 of the gripper means 134 being engaged with the rock mass "G" the latter can be fractured.

By repeating the above-mentioned step a number of times, a tunnel can be formed in the rock bed.

MODIFIED FORM

Next, other embodiments of the present invention will now be described below with reference to FIGS. 7 to 10.

Reference numeral 202 denotes a vehicle such as, for example, endless track type tractor, etc., having a turning body 204. The turning body 204 has a boom 206 fitted thereto so as to be moved up and down. The boom 206 can be moved up and down or vertically by the action of a cylinder 208.

Pivotally attached to the boom 206 is an arm 210 which can be actuated by means of an arm cylinder 212.

Pivotally connected by a pin 216 to the leading end of the arm 210 is a bracket 214 which can be oscillated by the action of the cylinder 218.

Figure 7:
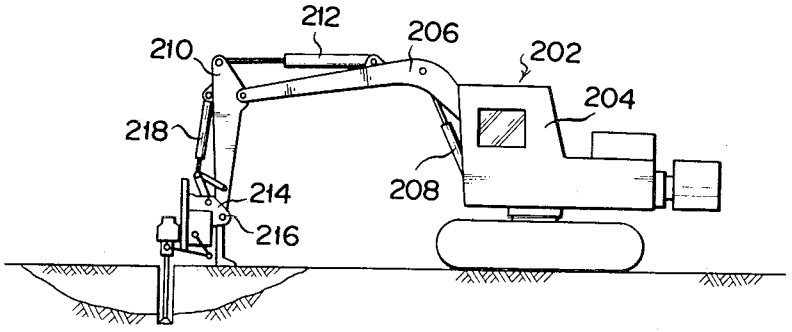
FIG. 7 is a front elevational view of another embodiment of an excavating apparatus according to the present invention.
Figure 8:
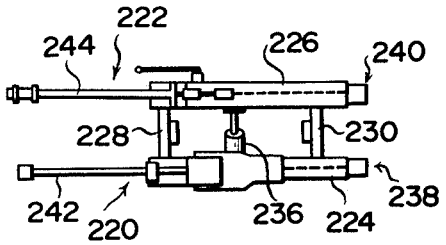
FIG. 8 is a plan view of an arrangement of a rock mass fracturing apparatus and a drilling means employed in the embodiment of FIG. 7.
Figure 9:
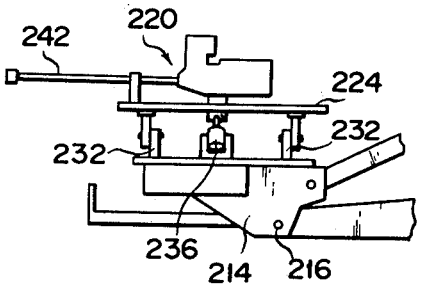
FIG. 9 is a side elevational view of FIG. 8.
Figure 10:
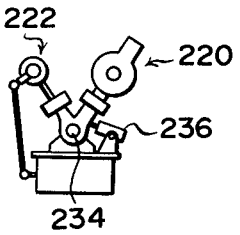
FIG. 10 is a front elevational view of FIG. 8.

The above-mentioned bracket 214 has a boring means 220 and a fracturing means 222 fitted thereto. The boring means 220 is nearly the same in construction as the planned excavation drilling means 6 employed in the above-mentioned first embodiment. Whilst, the fracturing means 222 has the nearly same construction as that of the aforementioned fracturing apparatus 8. However, the provision of the excavating blade 118 is not always required. Guide bars 224 and 226 having the boring means 220 and the fracturing means 222 mounted thereon, respectively, are interconnected by connector members 228 and 230. The connector members 228 and 230 are connected to supporting portions 232 of the bracket 214 by means of a pin 234 so that they can be oscillated. Mounted on the bracket 214 is a positioning cylinder 236 for giving oscillatory movement of the guide bars 224 and 226. The boring means 220 is mounted on the guide bar 224 so as to be moved forwards and backwards by actuating a moving operation means 238. Further, the fracturing means 220 is mounted on the guide bar 226 so as to be moved forwards and backwards by actuating a moving operation means 240. The details of the above-mentioned mounting means are the nearly same as that of the mounting means shown in FIG. 3.

Where it is desired to fracture the rock mass by means of the apparatus according to this embodiment, at first, the boring means 220 is driven to excavate the rock mass and form a fracturing hole in it. Upon completion of excavation of the rock bed to form the fracturing hole to a sufficient depth, the cylinder 218 is actuated to turn the boring means 220 and the fracturing means 222 about the pin 234 to position the rod 244 of the fracturing means 222 above the axis of the fracturing hole. Under such condition the moving operation means 240 is rendered operative to insert the rod 244 into the fracturing hole. The subsequent steps to be taken are the same as that of the aforementioned first embodiment. According to this embodiment, the arm 210 can be rotated by actuating the arm cylinder 212, and therefore in addition to the excavating posture or position as shown in FIG. 7 the vehicle can take a position for excavating rock walls extending at right angles to the ground surface.

While the present invention is susceptible of embodiments in many different forms, there is shown in the drawings and has been described herein in detail specific embodiments of the invention, with the understanding that the present disclosure is to be considered as an exemplification of the principles of the invention and is not intended to limit the invention to the embodiments illustrated.

What is claimed is:

1. A method of excavating a tunnel, shaft, channel or the like comrising the steps of:

(a) digging a hole in a rock bed or in the ground;

(b) inserting a rod of a fracturing apparatus in said hole, said rod having a communication hole formed therein in the axial direction, nozzle means formed at the leading end thereof and sealing means positioned both ahead of and behind said nozzle means, said fracturing apparatus having a water reservoir and a hydraulic booster;

(c) allowing pressurized water to spout from said nozzle means in the form of water jet so as to produce annular grooves in said hole impinged by the water jet, the pressurized water being introduced into said nozzle means from said water reservoir through said communication hole by the action of said hydraulic booster;

(d) sealing a space around said nozzle means radially defined by the outer periphery of said rod and an inner peripheral wall of said hole and axially defined by said sealing means positioned ahead of and behing said nozzle means; and (e) spouting pressurized water from said nozzle means into said space thereby making a crack in said rock mass, said crack being started from said annular grooves in said hole, the water pressure of this step being less than that of step (c) so that the rock mass can be fractured along said crack by continuously spouting pressurized water into said space.

2. The method of excavating a tunnel, shaft, channel or the like as defined in claim 1 further comprising the step of (f) pulling out said rod from said hole while the outer periphery of said rod is engaged with the inner peripheral wall of said hole thereby fracturing the rock mass along and from said crack.

3. An apparatus for excavating a tunnel, shaft, channel or the like comprising:

a base frame;

a guide bar rotatably mounted on said base frame;

a housing slidably mounted on said guide bar;

a rod slidably and rotatably mounted on said housing, said rod having a communication hole formed therein in the axial direction;

an excavating blade mounted on the leading end of said rod;

shock generating means mounted on said housing and being adapted to give shocks to said rod;

rotary driving means mounted on said housing and being operatively associated with said rod for rotating the same;

nozzle means formed in said rod, said nozzle means being connected with said communication hole;

a water reservoir;

hydraulic booster means mounted on said base frame, and piping means for connecting said water reservoir with said communication hole and said hydraulic booster means so that pressurized water produced by said hydraulic booster can be spouted in the form of water jet from said nozzle means thereby making a crack in a rock mass or in the ground to be excavated.

4. An apparatus for excavating a tunnel, shaft, channel or the like as defined in claim 3 wherein said apparatus is mounted on an endless-type tractor.

5. An apparatus for excavating a tunnel, shaft, channel or the like as defined in claim 4, further comprising drilling means mounted on said endless-type tractor, said drilling means having an excavating blade mounted on the leading end thereof.

6. An apparatus for excavating a tunnel, shaft, channel or the like comprising:

a base frame;

a guide bar rotatably mounted on said base frame;

a housing slidably mounted on said guide bar;

a rod slidably and rotatably mounted on said housing, said rod having a communication hole formed therein in the axial direction;

first sealing means mounted on said rod at the leading end thereof;

second sealing means mounted on said rod, the arrangement being made such that said nozzle means is sandwiched by said first and second sealing means;

deforming means for resiliently compressing said first and second sealing means in the axial direction thereof to expand said first and second sealing means radially thereby forming an enclosed space adjacent to said nozzle means defined by the outer periphery of said rod, said first and second sealing means, and the inner wall of a pre-drilled hole in the rock mass or in the ground through which said rod is to be inserted.

7. An apparatus for excavating a tunnel, shaft, channel or the like as defined in claim 6 wherein said apparatus is mounted on an endless-type tractor.

8. An apparatus for excavating a tunnel, shaft, channel or the like as defined in claim 7, further comprising drilling means mounted on said endless-type tractor, said drilling means having an excavating blade mounted on the leading end thereof.

9. An apparatus for excavating a tunnel, shaft, channel or the like as defined in claim 6 wherein said deforming means comprises hydraulic cylinder means mounted on said housing, a sleeve slidably mounted on said rod and adapted to be moved by the action of said hydraulic cylinder means, and a collar slidably mounted on said rod between said first and second sealing means, said collar having an aperture formed therein at a part thereof opposite to said nozzle means.

10. An apparatus for excavating a tunnel, shaft, channel or the like as defined in claim 9 wherein said rod has a groove formed therein and said sleeve has an aperture formed therein at a part opposite to the groove in said rod and wherein a gripper means is disposed in said groove and aperture.

11. An apparatus for excavating a tunnel, shaft, channel or the like comprising:

a base frame;

a guide bar rotatably mounted on said base frame;

a housing slidably mounted on said guide bar;

a rod slidably and rotatably mounted on said housing, said rod having a communication hole formed therein in the axial direction;

nozzle means detachably mounted in said rod and being connected with said communication hole wherein said nozzle means is interchangeable with other nozzle means having different nozzle hole angles thereby allowing different shapes of annular grooves and cracks to be formed for fracturing the different amounts of rock mass;

a water reservoir;

hydraulic booster means mounted on said base frame, and piping means for connecting said water reservoir with said communication hole and said hydraulic booster means so that pressurized water produced by said hydraulic booster can be spouted in the form of water jet from said nozzle means thereby making a crack in a rock mass or in the ground to be excavated.

12. An apparatus for excavating a tunnel, shaft, channel or the like as defined in claim 11 wherein said apparatus is mounted on an endless-type tractor.

13. An apparatus for excavating a tunnel, shaft, channel or the like as defined in claim 12, further comprising drilling means mounted on said endless-type tractor, said drilling means having an excavating blade mounted on the leading end thereof.

* * * * *